US012025355B2

(12) United States Patent
Yamasuso

(10) Patent No.: US 12,025,355 B2
(45) Date of Patent: Jul. 2, 2024

(54) OUTDOOR UNIT OF REFRIGERATION CYCLE APPARATUS

(71) Applicant: Mitsubishi Electric Corporation, Tokyo (JP)

(72) Inventor: Masaya Yamasuso, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 267 days.

(21) Appl. No.: 17/778,934

(22) PCT Filed: Jan. 23, 2020

(86) PCT No.: PCT/JP2020/002311

§ 371 (c)(1),
(2) Date: May 23, 2022

(87) PCT Pub. No.: WO2021/149222

PCT Pub. Date: Jul. 29, 2021

(65) Prior Publication Data

US 2022/0412618 A1 Dec. 29, 2022

(51) Int. Cl.

| | |
|---|---|
| ***F25B 41/42*** | (2021.01) |
| *F24F 1/14* | (2011.01) |
| *F24F 1/30* | (2011.01) |

(52) U.S. Cl.

CPC ..... *F25B 41/42* (2021.01); *F24F 1/14* (2013.01); *F24F 1/30* (2013.01); *F25B 2500/13* (2013.01)

(58) Field of Classification Search

CPC ..... F25B 41/40; F25B 41/42; F25B 2500/13; F25B 6/02; F24F 1/14; F24F 1/30;
(Continued)

(56) References Cited

U.S. PATENT DOCUMENTS 5,240,068 A 8/1993 Tokutake
5,379,834 A 1/1995 Tokutake
(Continued)

FOREIGN PATENT DOCUMENTS

EP 3 312 527 A1 4/2018
JP H04-353395 A 12/1992
(Continued)

OTHER PUBLICATIONS

Office Action dated Sep. 28, 2023 issued in corresponding CN Patent Application No. 202080090106.9 (and English machine translation).

(Continued)

*Primary Examiner* — Joseph F Trpisovsky
(74) *Attorney, Agent, or Firm* — Posz Law Group, PLC

(57) ABSTRACT

An outdoor unit of a refrigeration cycle apparatus includes a first header pipe and a second header pipe. The first header pipe and the second header pipe are connected to a heat-source-side heat exchanger. The outdoor unit further includes a refrigerant distributor pipe. The refrigerant distributor includes an inflow pipe into which refrigerant discharged from a compressor flows, a splitter pipe connected to the inflow pipe, a first feed pipe connected to the splitter pipe and to a first body portion of a first main pipe of the first header pipe, and a second feed pipe connected to the splitter pipe and to a second body portion of a second main pipe of the second header pipe.

5 Claims, 6 Drawing Sheets

(58) Field of Classification Search
CPC ..... F28D 1/05308; F28D 1/05316; F28F 9/0246; F28F 9/027
See application file for complete search history.

(56) References Cited

U.S. PATENT DOCUMENTS

| | | | |
|---|---|---|---|
| 5,509,473 | A | 4/1996 | Tokutake |
| 5,941,304 | A | 8/1999 | Inaba et al. |
| 2006/0243360 | A1 | 11/2006 | Takahashi |
| 2018/0156498 | A1 | 6/2018 | Matsumoto et al. |

FOREIGN PATENT DOCUMENTS

| | | | | |
|---|---|---|---|---|
| JP | H10-38496 | A | 2/1998 | |
| JP | 2002-115936 | A | 4/2002 | |
| JP | 2004-218083 | A | 8/2004 | |
| JP | 2008-089294 | A | 4/2008 | |
| JP | 5957535 | B2 | 7/2016 | |
| WO | 2014/068687 | A1 | 5/2014 | |
| WO | 2016/203581 | A1 | 12/2016 | |
| WO | 2016/208042 | A1 | 12/2016 | |
| WO | WO-2018047331 | A1 * | 3/2018 | ..... F24F 5/00 |

OTHER PUBLICATIONS

Examination Report dated Sep. 27, 2022 issued in corresponding IN Patent Application No. 202227040907 (and English translation).
Office Action dated Nov. 15, 2022 issued in corresponding JP Patent Application No. 2021-572220 (and English machine translation).
International Search Report of the International Search Authority mailed Mar. 17, 2020 in corresponding International Application No. PCT/JP2020/002311 (and English machine translation).
Office Action dated Feb. 7, 2024 issued in corresponding CN Patent Application No. CN 202080090106.9 (and English machine translation).

* cited by examiner

OUTDOOR UNIT OF REFRIGERATION CYCLE APPARATUS

CROSS REFERENCE TO RELATED APPLICATIONS

This application is a U.S. national stage application of PCT/JP2020/002311 filed on Jan. 23, 2020, the contents of which are incorporated herein by reference.

TECHNICAL FIELD

The present disclosure relates to an outdoor unit of a refrigeration cycle apparatus that includes a heat exchanger provided with header pipes.

BACKGROUND ART

Patent Literature 1 discloses an air-conditioning apparatus that is as a refrigeration cycle apparatus and that includes a plurality of gas header pipes through which refrigerant in a high-temperature, high-pressure gas phase that is discharged from a compressor is distributed over a heat exchanger.

CITATION LIST

Patent Literature

Patent Literature 1: International Publication No. 2016/208042

SUMMARY OF INVENTION

Technical Problem

A main pipe in each of the gas header pipes, which is disclosed by Patent Literature 1, is fixed to the heat exchanger with a plurality of branch pipes that are arranged apart from one another being interposed in between. When the high-temperature, high-pressure gas-phase refrigerant discharged from the compressor flows into the main pipe of the gas header pipe, the main pipe undergoes thermal expansion and is distorted. Therefore, a thermal stress occurs at the connections between the main pipe and the branch pipes. In particular, if the refrigerant flows into the main pipe along the longitudinal direction of the main pipe, the distribution of the refrigerant in the main pipe tends to become uneven, producing a temperature variation between the longitudinal ends of the main pipe. Such a temperature variation between the longitudinal ends of the main pipe cause thermal stresses at the connections between the main pipe and the branch pipes and may deform the branch pipes. Therefore, gas header pipes as disclosed by Patent Literature 1 are desired to be configured such that refrigerant in a high-temperature, high-pressure gas phase is evenly distributed inside the main pipes thereof.

The present disclosure is to solve the above problems and provides an outdoor unit of a refrigeration cycle apparatus in which refrigerant in a high-temperature, high-pressure gas phase is evenly distributed inside main pipes.

Solution to Problem

An outdoor unit of a refrigeration cycle apparatus according to an embodiment of the present disclosure includes a compressor. The compressor is configured to compress and discharge refrigerant. The outdoor unit further includes a heat-source-side heat exchanger. The heat-source-side heat exchanger includes a first heat-exchanger unit and a second heat-exchanger unit. The second heat-exchanger unit is provided below the first heat-exchanger unit. The outdoor unit further includes a first header pipe. The first header pipe includes a first main pipe and a plurality of first branch pipes. The first main pipe includes a first upper end portion, a first lower end portion, and a first body portion. The first body portion is provided between the first upper end portion and the first lower end portion. The plurality of first branch pipes are connected to the first main pipe and to the first heat-exchanger unit and arranged apart from one another. The outdoor unit further includes a second header pipe. The first header pipe includes a second main pipe and a plurality of second branch pipes. The second main pipe including a second upper end portion, a second lower end portion, and a second body portion. The second body portion is provided between the second upper end portion and the second lower end portion. The plurality of second branch pipes are connected to the second main pipe and to the second heat-exchanger unit and arranged apart from one another. The outdoor unit further includes a refrigerant distributor pipe. The refrigerant distributor pipe includes an inflow pipe. The refrigerant discharged from the compressor flows into the inflow pipe. The refrigerant distributor pipe further includes a splitter pipe. The splitter pipe is connected to the inflow pipe. The refrigerant distributor pipe further includes a first feed pipe. The first feed pipe is connected to the splitter pipe and to the first body portion. The refrigerant distributor pipe further includes a second feed pipe. The second feed pipe is connected to the splitter pipe and to the second body portion.

Advantageous Effects of Invention

The refrigerant discharged from the compressor and flowing into the first body portion of the first main pipe or into the second body portion of the second main pipe collides with the inner wall of the first body portion or the second body portion and is thus dispersed over the entirety of the first main pipe or the second main pipe. Inside the first main pipe or the second main pipe, since the refrigerant collides with the inner wall of the first body portion or the second body portion, the kinetic energy of the refrigerant that is caused in correspondence with the flow velocity at the time of inflow is reduced and the refrigerant is dispersed in dependence on gravity and pressure. Hence, the evenness in the dispersion is increased. Thus, the unevenness in the dispersion of the refrigerant inside the first main pipe or the second main pipe is reduced.

DESCRIPTION OF EMBODIMENTS

Embodiment 1

Figure 1:
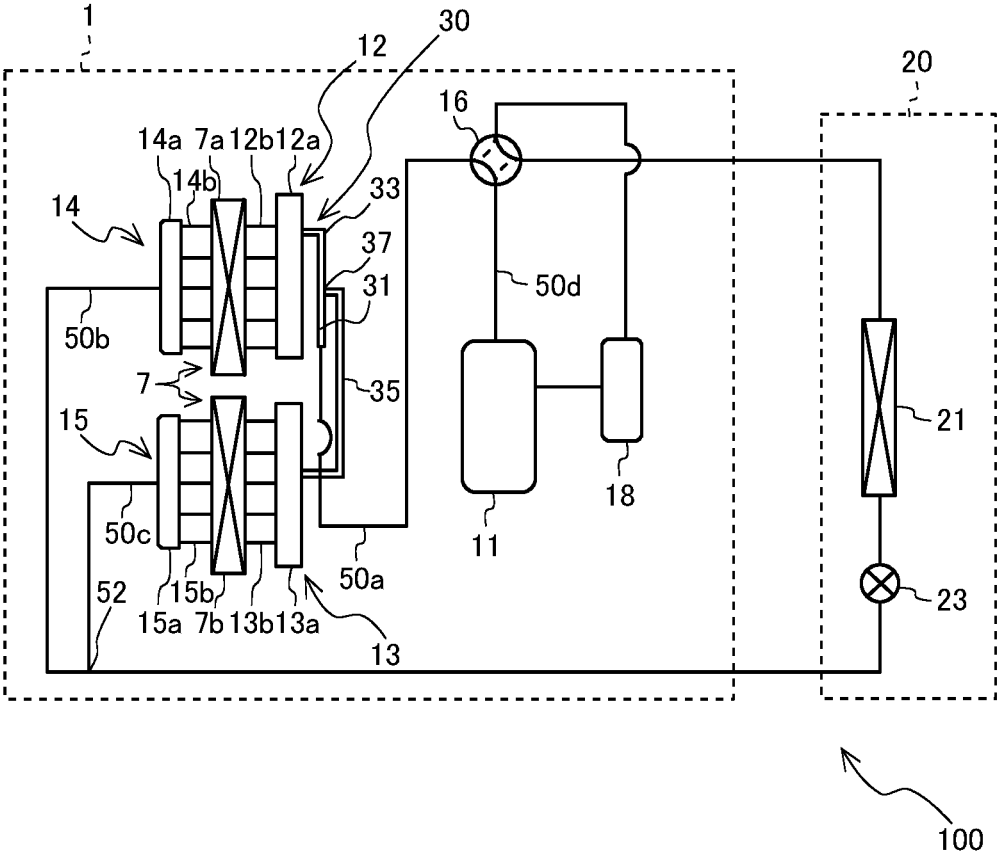
FIG. 1 illustrates an exemplary refrigerant circuit of a refrigeration cycle apparatus according to Embodiment 1.

A refrigeration cycle apparatus 100 according to Embodiment 1 will now be described with reference to FIG. 1. FIG. 1 illustrates an exemplary refrigerant circuit of the refrigeration cycle apparatus 100 according to Embodiment 1. In the drawings including FIG. 1 to be referred to below, the sizes and shapes of individual elements may be different from the actual sizes and shapes thereof. In the drawings including FIG. 1 to be referred to below, elements or portions that have the same configurations or functions are denoted by the same reference signs, respectively, or the reference signs of such elements or portions may be omitted.

As illustrated in FIG. 1, the refrigeration cycle apparatus 100 includes an outdoor unit 1 and an indoor unit 20. The indoor unit 20 is connected to the outdoor unit 1 by refrigerant pipes such as extension pipes. The outdoor unit 1 and the indoor unit 20, which are illustrated one each in FIG. 1, may each be provided in plural number. The refrigeration cycle apparatus 100 may include a relay device between the outdoor unit 1 and the indoor unit 20. The refrigerant pipes connecting the outdoor unit 1 and the indoor unit 20 to each other may be existing refrigerant pipes originally provided in an installation site of interest or may be refrigerant pipes newly provided to the installation site.

In the following description, the term "cooling operation" refers to a mode of operation of the refrigeration cycle apparatus 100 in which refrigerant in a low-temperature, low-pressure two-phase state is caused to flow from the outdoor unit 1 into the indoor unit 20. Furthermore, the term "heating operation" refers to a mode of operation of the refrigeration cycle apparatus 100 in which refrigerant in a high-temperature, high-pressure gas phase is caused to flow from the outdoor unit 1 into the indoor unit 20.

The outdoor unit 1 includes a heat-source-side heat exchanger 7, a compressor 11, a refrigerant passage switcher 16, and an accumulator 18. The indoor unit 20 includes a load-side heat exchanger 21 and a decompressor 23.

The heat-source-side heat exchanger 7 is configured to cause two fluids having different levels of heat energy to transfer and exchange the heat energy therebetween. The heat-source-side heat exchanger 7 serves as a condenser in the cooling operation and as an evaporator in the heating operation. The condenser of the refrigeration cycle apparatus 100 may also be referred to as a radiator.

The heat-source-side heat exchanger 7 is, for example, a fin-and-tube heat exchanger, which includes a plurality of fins arranged apart from one another, and a plurality of heat exchanger tubes arranged apart from one another and each extending through the plurality of fins. In the fin-and-tube heat exchanger, refrigerant flowing in the plurality of heat exchanger tubes and air flowing between the plurality of fins are caused to exchange heat with each other. Such heat exchanger tubes of the heat-source-side heat exchanger 7 are not illustrated in FIG. 1.

The heat-source-side heat exchanger 7 includes a first heat-exchanger unit 7*a* and a second heat-exchanger unit 7*b*. The first heat-exchanger unit 7*a* is provided with a first header pipe 12, which is connected to one end of each of the heat exchanger tubes of the first heat-exchanger unit 7*a*. The first header pipe 12 includes a first main pipe 12*a* and a plurality of first branch pipes 12*b*. The first branch pipes 12*b* are connected to the first main pipe 12*a* and to the heat exchanger tubes of the first heat-exchanger unit 7*a* and are arranged apart from one another. The second heat-exchanger unit 7*b* is provided with a second header pipe 13, which is connected to one end of each of the heat exchanger tubes of the second heat-exchanger unit 7*b*. The second header pipe 13 includes a second main pipe 13*a* and a plurality of second branch pipes 13*b*. The second branch pipes 13*b* are connected to the second main pipe 13*a* and to the heat exchanger tubes of the second heat-exchanger unit 7*b* and are arranged apart from one another.

The first main pipe 12*a* and the second main pipe 13*a* are connected to a refrigerant distributor pipe 30. A first refrigerant pipe 50*a* is provided between the refrigerant passage switcher 16 and the heat-source-side heat exchanger 7 and is connected to the refrigerant distributor pipe 30 and to the refrigerant passage switcher 16. The refrigerant distributor pipe 30 includes an inflow pipe 31, a first feed pipe 33, a second feed pipe 35, and a splitter pipe 37. One end of the inflow pipe 31 is connected to the first refrigerant pipe 50*a*. The other end of the inflow pipe 31 is connected to the splitter pipe 37. One end of the second feed pipe 35 is connected to the second main pipe 13*a*. The other end of the second feed pipe 35 is connected to the splitter pipe 37

Details of the heat-source-side heat exchanger 7, the first header pipe 12, the second header pipe 13, and the refrigerant distributor pipe 30 will be described separately below.

The first heat-exchanger unit 7*a* is provided with a first distributor 14, which is connected to the other end of each of the heat exchanger tubes of the first heat-exchanger unit 7*a*. The first distributor 14 includes a third main pipe 14*a* and a plurality of third branch pipes 14*b*. The third branch pipes 14*b* are connected to the third main pipe 14*a* and to the heat exchanger tubes of the first heat-exchanger unit 7*a* and are arranged apart from one another. The second heat-exchanger unit 7*b* is provided with a second distributor 15, which is connected to the other end of each of the heat exchanger tubes of the second heat-exchanger unit 7*b*. The second distributor 15 includes a fourth main pipe 15*a* and a plurality of fourth branch pipes 15*b*. The fourth branch pipes 15*b* are connected to the fourth main pipe 15*a* and to the heat exchanger tubes of the second heat-exchanger unit 7*b* and are arranged apart from one another.

The third main pipe 14*a* of the first distributor 14 receives a second refrigerant pipe 50*b*. The fourth main pipe 15*a* of the second distributor 15 receives a third refrigerant pipe 50*c*. Portions of the refrigerant having undergone heat exchange in the heat-source-side heat exchanger 7 and respectively flowed into the second refrigerant pipe 50*b* and the third refrigerant pipe 50*c* are joined together in a combining unit 52, such as a combiner. The joined refrigerant flows from the outdoor unit 1 into the indoor unit 20.

The first distributor 14 may be of the same configuration and the same shape as the first header pipe 12 or of a different configuration and a different shape from the first header pipe 12. The second distributor 15 may be of the same configuration and the same shape as the second header pipe 13 or of a different configuration and a different shape from the second header pipe 13. For example, the third branch pipes 14*b* of the first distributor 14 and the fourth branch pipes 15*b* of the second distributor 15 may be capillary tubes.

The compressor 11 is configured to compress the refrigerant, which is at a low pressure when suctioned, and discharge the refrigerant as high-pressure refrigerant. The compressor 11 is, for example, a displacement compressor such as a reciprocating compressor, a rotary compressor, or a scroll compressor. The compressor 11 receives on the discharge side thereof one end of a fourth refrigerant pipe 50*d*. The other end of the fourth refrigerant pipe 50*d* is connected to the refrigerant passage switcher 16.

The refrigerant passage switcher 16 is configured to switch the passage thereinside with reference to an electric signal in correspondence with the switching between the cooling operation and the heating operation to be performed by the refrigeration cycle apparatus 100. In FIG. 1, the passage to be established in the refrigerant passage switcher 16 in the cooling operation is represented by solid lines, and the passage to be established in the refrigerant passage switcher 16 in the heating operation is represented by dotted lines. The first refrigerant pipe 50*a*, which is connected to one end of the inflow pipe 31, is connected at an end thereof to the refrigerant passage switcher 16.

The refrigerant passage switcher 16 is, for example, a four-way valve to which an operation of a solenoid valve is applied. Alternatively, the refrigerant passage switcher 16 may be a combination of two-way valves or three-way valves. Moreover, the refrigerant passage switcher 16 may be omitted depending on factors such as the usage and functions of the refrigeration cycle apparatus 100. For example, if the refrigeration cycle apparatus 100 is configured to perform a cooling operation alone, the refrigerant passage switcher 16 and the fourth refrigerant pipe 50*d* can be omitted. If the refrigerant passage switcher 16 and the fourth refrigerant pipe 50*d* are omitted, the first refrigerant pipe 50*a* connected to the one end of the inflow pipe 31 is directly connected at the end thereof to the discharge side of the compressor 11.

The accumulator 18 has an inlet pipe and an outlet pipe. One end of each of the inlet pipe and the outlet pipe is positioned in the space inside the accumulator 18. The other end of the inlet pipe is connected to the refrigerant passage switcher 16. The other end of the outlet pipe is connected to the suction side of the compressor 11. The accumulator 18 may be omitted depending on factors such as the usage and functions of the refrigeration cycle apparatus 100.

The accumulator 18 has a refrigerant-storing function and a gas-liquid-separating function. The refrigerant-storing function of the accumulator 18 is a function of storing an excessive portion of the refrigerant that results from the difference between the amount of refrigerant in the heating operation and the amount of refrigerant in the cooling operation. The gas-liquid-separating function of the accumulator 18 is a function of retaining liquid refrigerant caused during the operation of the refrigeration cycle apparatus 100 and thus preventing an excessive inflow of liquid refrigerant into the compressor 11.

The load-side heat exchanger 21 is configured to cause two fluids having different levels of heat energy to transfer and exchange the heat energy therebetween, as with the heat-source-side heat exchanger 7 described above. The load-side heat exchanger 21 serves as an evaporator in the cooling operation and as a condenser in the heating operation. The load-side heat exchanger 21 may be an air-cooled heat exchanger or a water-cooled heat exchanger, depending on factors such as the usage and functions of the refrigeration cycle apparatus 100. Examples of the air-cooled heat exchangers include a fin-and-tube heat exchanger and a plate-fin heat exchanger. Examples of the water-cooled heat exchanger include a shell-and-tube heat exchanger, a plate heat exchanger, and a double-tube heat exchanger.

The decompressor 23 is configured to expand and decompress the refrigerant that is in a high-pressure liquid phase. The decompressor 23 is a device such as an expansion device, an automatic thermostatic expansion valve, or a linear electric expansion valve. An expansion device refers to a mechanical expansion valve employing a diaphragm serving as a pressure-receiving component. An automatic thermostatic expansion valve is configured to adjust the amount of refrigerant with reference to the degree of superheat of the refrigerant in a gas phase on the suction side of the compressor 11. A linear electric expansion valve has an opening degree that is adjustable in a stepwise or continuous manner and is abbreviated to LEV. The decompressor 23, which is provided only in the indoor unit 20 in FIG. 1, may alternatively be provided only in the outdoor unit 1 or in each of the outdoor unit 1 and the indoor unit 20.

The refrigeration cycle apparatus 100 may include devices other than those described above. For example, the refrigeration cycle apparatus 100 may include a subcooling heat exchanger or an oil separator.

The refrigeration cycle apparatus 100 is configured such that the heat-source-side heat exchanger 7, the compressor 11, the refrigerant passage switcher 16, and the accumulator 18 that are included in the outdoor unit 1, and the load-side heat exchanger 21 and the decompressor 23 that are included in the indoor unit 20 are connected to one another by the refrigerant pipes. Thus, a refrigerant circuit through which the refrigerant circulates is formed in the refrigeration cycle apparatus 100. Among the refrigerant pipes that form the refrigerant circuit, those provided between the first header pipe 12 or the second header pipe 13 and the load-side heat exchanger 21 are hereinafter referred to as high-temperature-side refrigerant pipes. The high-temperature-side refrigerant pipes of the outdoor unit 1 include the refrigerant distributor pipe 30, the first refrigerant pipe 50*a*, and the fourth refrigerant pipe 50*d*. Among the refrigerant pipes that form the refrigerant circuit, those provided between the first distributor 14 or the second distributor 15 and the load-side heat exchanger 21 are hereinafter referred to as low-temperature-side refrigerant pipes. The low-temperature-side refrigerant pipes of the outdoor unit 1 include the second refrigerant pipe 50*b* and the third refrigerant pipe 50*c*.

Now, the behavior of the refrigerant circuit of the refrigeration cycle apparatus 100 in the cooling operation will be outlined. In the cooling operation, the refrigerant passage switcher 16 is controlled to establish the passage represented by the solid lines in FIG. 1.

In the outdoor unit 1, the refrigerant discharged from the compressor 11 is in a high-temperature, high-pressure gas phase and flows into the fourth refrigerant pipe 50*d*. The refrigerant having flowed into the fourth refrigerant pipe 50*d* flows through the passage in the refrigerant passage switcher 16, the first refrigerant pipe 50*a*, the refrigerant distributor pipe 30, and the first and second header pipes 12 and 13 into the heat-source-side heat exchanger 7. In the cooling operation, the heat-source-side heat exchanger 7 serves as a condenser. The high-temperature, high-pressure gas-phase refrigerant having flowed into the heat-source-side heat exchanger 7 exchanges heat in the heat-source-side heat exchanger 7 with air flowing between the fins of the heat-source-side heat exchanger 7 and thus turns into high-pressure liquid-phase refrigerant before being discharged.

The high-pressure liquid-phase refrigerant discharged from the heat-source-side heat exchanger 7 flows out of the outdoor unit 1 through the first distributor 14 and the second refrigerant pipe 50*b* and through the second distributor 15 and the third refrigerant pipe 50*c* into the indoor unit 20.

The high-pressure liquid-phase refrigerant having flowed into the indoor unit 20 flows into the decompressor 23. The high-pressure gas-phase refrigerant having flowed into the decompressor 23 is expanded and decompressed by the decompressor 23 into low-temperature, low-pressure two-phase refrigerant and is discharged from the decompressor 23. The low-temperature, low-pressure two-phase refrigerant discharged from the decompressor 23 flows into the load-side heat exchanger 21. In the cooling operation, the load-side heat exchanger 21 serves as an evaporator. The low-temperature, low-pressure two-phase refrigerant having flowed into the load-side heat exchanger 21 exchanges heat in the load-side heat exchanger 21 with indoor air or a heat medium such as water or brine and thus turns into low-pressure gas-phase refrigerant before being discharged. Occasionally, the refrigerant discharged from the load-side heat exchanger 21 may be in a low-pressure, high-quality two-phase state. The low-pressure gas-phase refrigerant discharged from the load-side heat exchanger 21 flows out of the indoor unit 20 into the outdoor unit 1.

The low-pressure gas-phase refrigerant having flowed into the outdoor unit 1 flows through the passage in the refrigerant passage switcher 16 and is suctioned into the accumulator 18. In the accumulator 18, any liquid-phase component of the refrigerant is separated from the refrigerant, and only the gas-phase component of the refrigerant is suctioned into the compressor 11. The low-pressure gas-phase refrigerant suctioned into the compressor 11 is compressed by the compressor 11 into high-temperature, high-pressure gas-phase refrigerant and is discharged from the compressor 11 into the fourth refrigerant pipe 50*d*. In the cooling operation, the refrigeration cycle apparatus 100 undergoes the above cycle repeatedly.

Now, the behavior of the refrigerant circuit of the refrigeration cycle apparatus 100 in the heating operation will be outlined. In the heating operation, the refrigerant passage switcher 16 is controlled to establish the passage represented by the dotted lines in FIG. 1.

The refrigerant discharged from the compressor 11 is in a high-temperature, high-pressure gas phase and flows out of the outdoor unit 1 through the fourth refrigerant pipe 50*d* and the passage in the refrigerant passage switcher 16 into the indoor unit 20.

The high-temperature, high-pressure gas-phase refrigerant having flowed into the indoor unit 20 flows into the load-side heat exchanger 21. In the heating operation, the load-side heat exchanger 21 serves as a condenser. The high-temperature, high-pressure gas-phase refrigerant having flowed into the load-side heat exchanger 21 exchanges heat in the load-side heat exchanger 21 with indoor air or a heat medium such as water or brine and thus turns into high-pressure liquid-phase refrigerant before being discharged. The high-pressure liquid-phase refrigerant discharged from the load-side heat exchanger 21 flows into the decompressor 23. The high-pressure liquid-phase refrigerant having flowed into the decompressor 23 is expanded and decompressed by the decompressor 23 into low-temperature, low-pressure two-phase refrigerant and is discharged from the decompressor 23. The low-temperature, low-pressure two-phase refrigerant discharged from the decompressor 23 flows out of the indoor unit 20 into the outdoor unit 1.

The low-temperature, low-pressure two-phase refrigerant having flowed into the outdoor unit 1 flows through the second refrigerant pipe 50*b* and the first distributor 14 and through the third refrigerant pipe 50*c* and the second distributor 15 into the heat-source-side heat exchanger 7. In the heating operation, the heat-source-side heat exchanger 7 serves as an evaporator. The low-temperature, low-pressure two-phase refrigerant having flowed into the heat-source-side heat exchanger 7 exchanges heat in the heat-source-side heat exchanger 7 with air flowing between the fins of the heat-source-side heat exchanger 7 and thus turns into low-pressure gas-phase refrigerant before being discharged. Occasionally, the refrigerant discharged from the heat-source-side heat exchanger 7 may be in a low-pressure, high-quality two-phase state.

The low-pressure gas-phase refrigerant discharged from the heat-source-side heat exchanger 7 flows through the first and second header pipes 12 and 13, the refrigerant distributor pipe 30, the first refrigerant pipe 50*a*, and the passage in the refrigerant passage switcher 16 and is suctioned into the accumulator 18. In the accumulator 18, any liquid-phase component of the refrigerant is separated from the refrigerant, and only the gas-phase component of the refrigerant is suctioned into the compressor 11. The low-pressure gas-phase refrigerant suctioned into the compressor 11 is compressed by the compressor 11 into high-temperature, high-pressure gas-phase refrigerant and is discharged from the compressor 11 into the fourth refrigerant pipe 50*d*. In the heating operation, the refrigeration cycle apparatus 100 undergoes the above cycle repeatedly.

Figure 2:
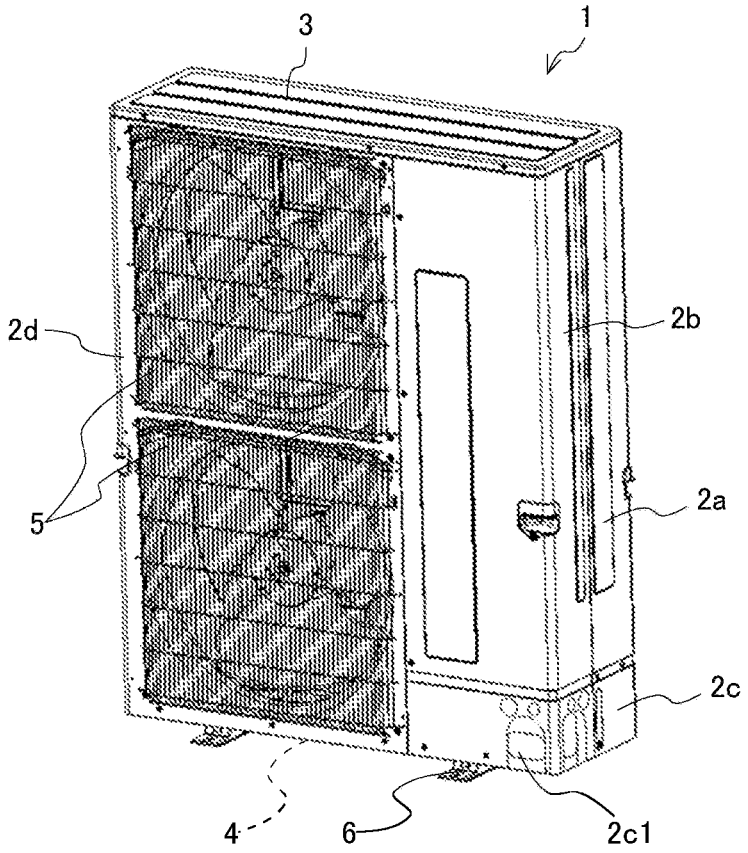
FIG. 2 is a perspective view of an outdoor unit according to Embodiment 1, illustrating an exemplary exterior configuration thereof.
Figure 3:
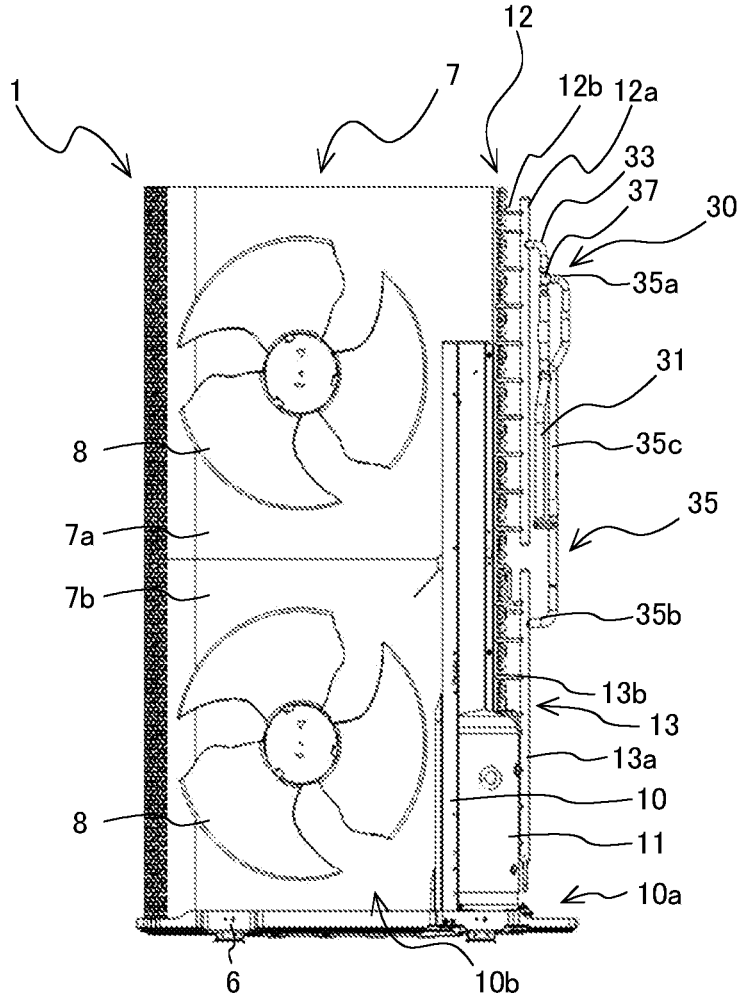
FIG. 3 is a front view of the outdoor unit illustrated in FIG. 2, schematically illustrating a part of the interior configuration thereof.

Now, an exterior configuration of the outdoor unit 1 of the refrigeration cycle apparatus 100 will be described with reference to FIG. 2. FIG. 2 is a perspective view of the outdoor unit 1 according to Embodiment 1, illustrating an exemplary exterior configuration thereof. FIG. 3 is a front view of the outdoor unit 1 illustrated in FIG. 2, schematically illustrating a part of the interior configuration thereof. In the following description, the positional relationship between relevant elements of the outdoor unit 1 in directions including the vertical direction, the front-rear direction, and the horizontal direction basically refers to a positional relationship in a state where the outdoor unit 1 is installed for use.

While Embodiment 1 concerns an exemplary case where the outdoor unit 1 is a floor-standing heat-source-side unit, the outdoor unit 1 may be any heat-source-side unit, such as a heat-source-side unit of a wall-hanging type, a rooftop type, or a ceiling-hanging type, alternatively to the one of a floor-standing type.

The outdoor unit 1 includes a first side panel 2*a*, a second side panel 2*b*, a third side panel 2*c*, a fourth side panel 2*d*, a top panel 3, a bottom panel 4, exhaust grilles 5, and legs 6. The first side panel 2*a*, the second side panel 2*b*, the third side panel 2*c*, the fourth side panel 2*d*, the top panel 3, and the bottom panel 4 form the housing of the outdoor unit 1.

The first side panel 2*a* is a metal sheet panel including a right-face portion and a rear-face that form an L shape in top view. The first side panel 2*a* spreads over an upper rear part of the right face of the outdoor unit 1 and an upper right part of the rear face of the outdoor unit 1 and thus forms a part of the housing of the outdoor unit 1. The first side panel 2*a* has beads for reinforcement of the first side panel 2*a*. The first side panel 2*a* is attached to the top panel 3 and to the third side panel 2*c*. The first side panel 2*a* may be detachably attached to the top panel 3 and to the third side panel 2*c* by screwing or any other method, or may be fixed thereto by soldering or any other method. The right-face portion and the rear-face portion of the first side panel 2*a* may be formed of respective metal sheet panels that are separate from each other.

The second side panel 2*b* is a metal sheet panel including a front-face portion and a right-face portion that form an L shape in top view. The second side panel 2*b* spreads over an upper right part of the front face of the outdoor unit 1 and an upper front part of the right face of the outdoor unit 1 and thus forms a part of the housing of the outdoor unit 1. The second side panel 2*b* has beads for reinforcement of the first side panel 2*a*. The second side panel 2*b* is detachably attached to the top panel 3, to the first side panel 2*a*, and to the third side panel 2*c* by screwing or any other method so that the maintenance of the elements inside the outdoor unit 1 can be performed. On-site work such as the installation, repair, or removal of the outdoor unit 1 is to be performed with at least the second side panel 2*b* detached.

The third side panel 2*c* is a metal sheet panel including a front-face portion, a right-face portion, and a rear-face portion that form a U shape in top view. The third side panel 2*c* spreads over a lower right part of the front face of the outdoor unit 1, a lower part of the right face of the outdoor unit 1, and a lower right part of the rear face of the outdoor unit 1 and thus forms a part of the housing of the outdoor unit 1. The third side panel 2*c* has a plurality of openings 2*c*1. Extension pipes, which may be existing pipes for example, connected to relevant elements including the indoor unit 20 are drawn into the outdoor unit 1 through the openings 2*c*1. The openings 2*c*1 can be provided in, for example, an area near the front right corner of the third side panel 2*c*: that is, a right part of the front-face portion and a front part of the right-face portion of the third side panel 2*c*.

The third side panel 2*c* is attached to the bottom panel 4. The third side panel 2*c* may be detachably attached to the bottom panel 4 by screwing or any other method, may be fixed to the bottom panel 4 by soldering or any other method, or may be integrated with the bottom panel 4. Depending on the usage or other relevant factors of the outdoor unit 1, the third side panel 2*c* may be omitted, with the first side panel 2*a* and the second side panel 2*b* being attached to the bottom panel 4. The front-face portion, the right-face portion, and the rear-face portion of the third side panel 2*c* may be formed of respective metal sheet panels that are separate from one another.

The fourth side panel 2*d* is a metal sheet panel including a front-face portion and a left-face portion that form an L shape in top view. The fourth side panel 2*d* spreads over a left part of the front face of the outdoor unit 1 and the left face of the outdoor unit 1 and thus forms a part of the housing of the outdoor unit 1. The front-face portion of the fourth side panel 2*d* is provided with the exhaust grilles 5, which are detachably attached thereto. The exhaust grilles 5 cover the front side of exhaust ports that are continuous with the inside of the outdoor unit 1. FIG. 2 illustrates a case where two exhaust grilles 5 are provided. The method of attaching the exhaust grilles 5 to the front-face portion of the fourth side panel 2*d* may be fitting, screwing, or any other method. The left-face portion of the fourth side panel 2*d* may be provided with a suction grille having a plurality of air inlets. Such a suction grille is not illustrated in the drawings including FIG. 2.

The fourth side panel 2*d* is attached to the top panel 3 and to the bottom panel 4. The fourth side panel 2*d* may be detachably attached to the top panel 3 and to the bottom panel 4 by screwing or any other method, or may be fixed thereto by soldering or any other method. The front-face portion and the left-face portion of the fourth side panel 2*d* may be formed of respective metal sheet panels that are separate from each other.

The top panel 3 is a metal sheet panel spreading over the top face of the outdoor unit 1 and forms a part of the housing of the outdoor unit 1. As described above, the first side panel 2*a*, the second side panel 2*b*, and the fourth side panel 2*d* are attached to the top panel 3. The top panel 3 has on the upper surface thereof a plurality of beads for reinforcement of the top panel 3.

The bottom panel 4, which is also referred to as unit base, is a metal sheet panel spreading over the bottom face of the outdoor unit 1 and forms a part of the housing of the outdoor unit 1. As described above, the third side panel 2*c* and the fourth side panel 2*d* are attached to the bottom panel 4.

The bottom panel 4 is provided on the lower surface thereof with a plurality of legs 6, which serve as supports for the installation of the outdoor unit 1. The legs 6 are fixed to a concrete block or any other foundation with bolts or any other components.

An interior configuration of the outdoor unit 1 of the refrigeration cycle apparatus 100 will now be described with reference to FIG. 3. FIG. 3 is a front view of the outdoor unit 1 illustrated in FIG. 2, schematically illustrating a part of the interior configuration thereof. In FIG. 3, as a matter of convenience of description, some of the devices and refrigerant pipes described with reference to FIG. 1 are not illustrated.

As illustrated in FIG. 3, the outdoor unit 1 includes the heat-source-side heat exchanger 7, the compressor 11, the first header pipe 12, the second header pipe 13, and the refrigerant distributor pipe 30, which have been described above, and further includes fans 8 and a separator 10.

The separator 10 is a metal sheet panel that separates the space inside the outdoor unit 1. A lower peripheral part of the separator 10 is attached to the bottom panel 4 by screwing, soldering, or any other method. The fourth side panel 2*d*, not illustrated, is attached to the front face of the separator 10 by screwing, soldering, or any other method. The second side panel 2*b*, not illustrated, is detachably attached to the front face of the separator 10 by fitting or any other method. The top face of the separator 10 carries an electric component box, not illustrated. The electric component box houses circuitry including an inverter circuit and a control circuit intended for frequency control of the compressor 11 or the fans 8.

The space inside the outdoor unit 1 is separated by the separator 10 into a machine chamber 10*a* and a fan chamber 10*b*. The machine chamber 10*a* houses the compressor 11; and the first header pipe 12, the second header pipe 13, and the refrigerant distributor pipe 30 that are provided between the compressor 11 and the heat-source-side heat exchanger 7. The fan chamber 10*b* houses the heat-source-side heat exchanger and the fans 8.

The heat-source-side heat exchanger 7 has an L shape in top view, which is not illustrated. The heat-source-side heat exchanger 7 is placed on a left peripheral part and a rear peripheral part of the bottom panel 4 such that the heat exchanger tubes thereof extend horizontally. A part of the heat-source-side heat exchanger 7 that extends on the rear side of the outdoor unit 1 defines the fan chamber 10*b* in combination with the fourth side panel 2*d*, the top panel 3, the bottom panel 4, and the separator 10. The heat-source-side heat exchanger 7 is provided at the left end thereof with a first side plate, which is not illustrated. The first side plate extends in the vertical direction in such a manner as to be aligned with the first heat-exchanger unit 7*a* and the second heat-exchanger unit 7*b*. The first side plate is attached to the rear face of the separator 10 by screwing or any other method. The heat-source-side heat exchanger 7 is provided at the front end thereof with a second side plate, which is not illustrated. The second side plate extends in the vertical direction in such a manner as to be aligned with the first heat-exchanger unit 7*a* and the second heat-exchanger unit 7*b*. The fourth side panel 2*d* is attached to the second side plate by screwing or any other method. The shape of the heat-source-side heat exchanger 7 is not limited to an L shape and may be a flat shape or a U shape.

In the heat-source-side heat exchanger 7, the second heat-exchanger unit 7*b* is positioned below the first heat-exchanger unit 7*a*. The first heat-exchanger unit 7*a* and the second heat-exchanger unit 7*b* of the heat-source-side heat exchanger 7 may be provided either as separate air-cooled heat exchangers or as two heat-exchange areas of a single air-cooled heat exchanger. For example, the heat-exchange area of a single air-cooled heat exchanger may be divided into two areas such that the heat-exchange area having heat exchanger tubes connected to the first header pipe 12 is defined as the first heat-exchanger unit 7*a*, and the heat-exchange area having heat exchanger tubes connected to the second header pipe 13 is defined as the second heat-exchanger unit 7*b*.

The fan chamber 10*b* houses two fans 8. The fans 8 are each configured to induce an airflow from the outside of the outdoor unit 1 into the fan chamber 10*b* with the rotation of blades, thereby causing the airflow to pass through a corresponding one of the first heat-exchanger unit 7*a* and the second heat-exchanger unit 7*b*. The fans 8 are oriented to face the exhaust grilles 5 illustrated in FIG. 1. With the rotation of the fans 8, the air having undergone heat exchange by passing through the heat-source-side heat exchanger 7 is exhausted to the outside of the outdoor unit 1 through the exhaust grilles 5. The fans 8 may each be, for example, an axial-flow fan such as a propeller fan. The fans 8 are attached to a fan support, which is not illustrated. The fan support is provided on the rear side with respect to the blades of the fans 8 and on the front side with respect to the heat-exchange area of the heat-source-side heat exchanger 7 that extends on the rear side of the outdoor unit 1.

The compressor 11 is attached to the bottom panel 4 by screwing or any other method while being mounted on a compressor-mounting base, which is not illustrated but is formed in the bottom panel 4. The refrigerant pipes connected to the compressor 11, including the first refrigerant pipe 50*a* and the fourth refrigerant pipe 50*d* illustrated in FIG. 1 for example, are not illustrated in FIG. 3.

Figure 4:
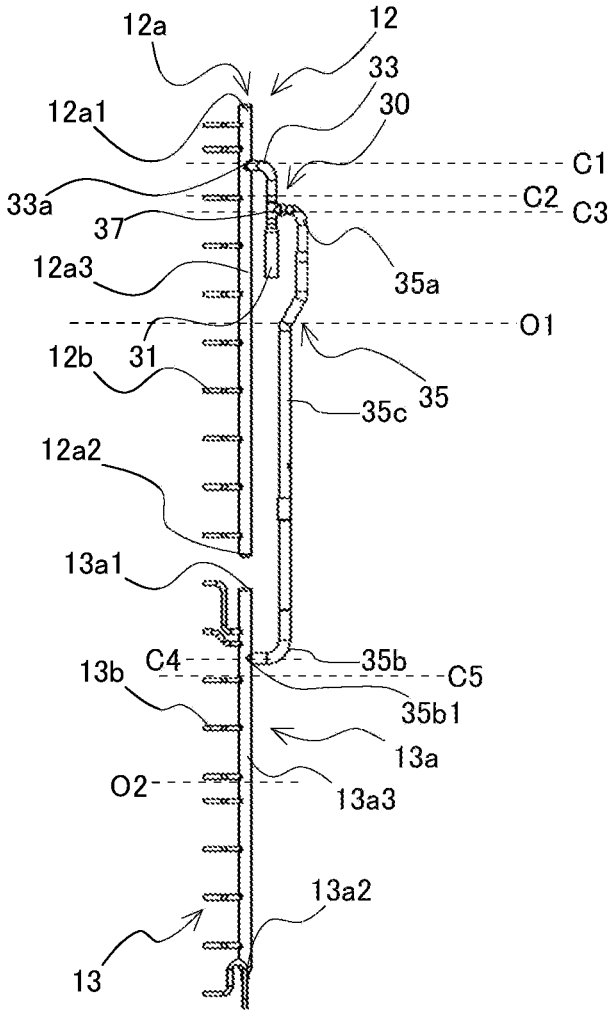
FIG. 4 is an enlargement of a part of FIG. 3, illustrating a first header pipe, a second header pipe, and a refrigerant distributor pipe.
Figure 5:
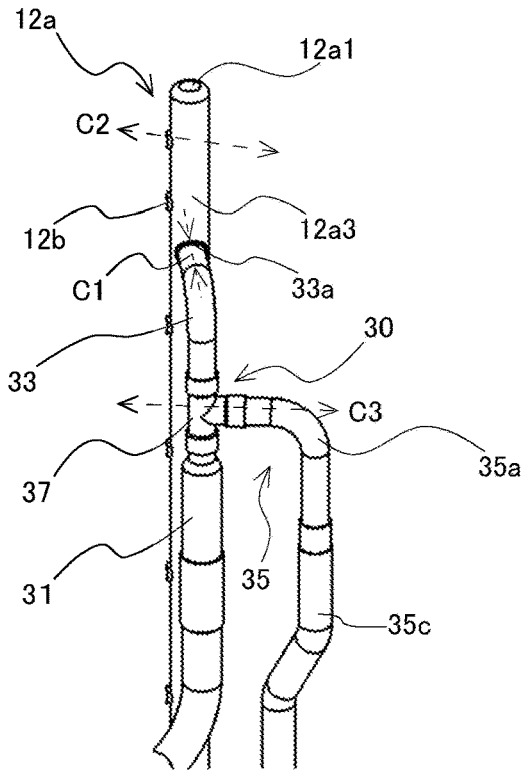
FIG. 5 is an enlargement of a part of FIG. 4 where the first header pipe and the refrigerant distributor pipe are connected to each other.
Figure 6:
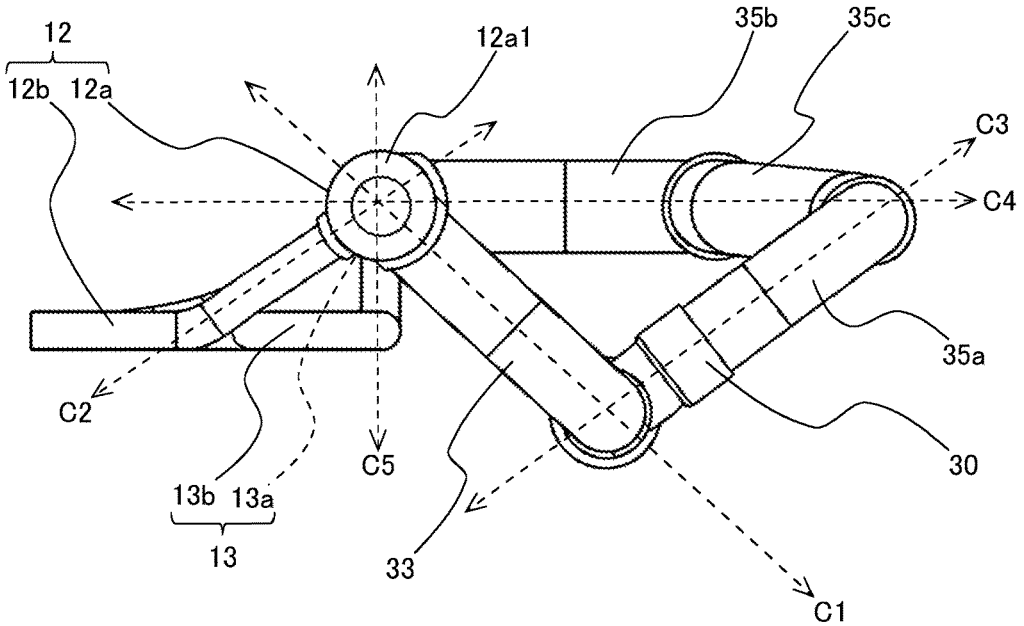
FIG. 6 is a top view of the first header pipe, the second header pipe, and the refrigerant distributor pipe illustrated in FIG. 4, seen from above a first upper end portion of a first main pipe.

Now, configurations of the first header pipe 12 and the second header pipe 13 that are connected to the heat-source-side heat exchanger 7, and the refrigerant distributor pipe 30 through which the refrigerant is distributed between the first header pipe 12 and the second header pipe 13 will be described with reference to FIGS. 4 to 6, in addition to FIG. 3. FIG. 4 is an enlargement of a part of FIG. 3, illustrating the first header pipe 12, the second header pipe 13, and the refrigerant distributor pipe 30. FIG. 5 is an enlargement of a part of FIG. 4 where the first header pipe 12 and the refrigerant distributor pipe 30 are connected to each other. FIG. 6 is a top view of the first header pipe 12, the second header pipe 13, and the refrigerant distributor pipe 30 illustrated in FIG. 4, seen from above a first upper end portion 12*a*1 of the first main pipe 12*a*.

The first header pipe 12 includes the first main pipe 12*a* connected to the refrigerant distributor pipe 30. The first main pipe 12*a* includes the first upper end portion 12*a*1, a first lower end portion 12*a*2, and a first body portion 12*a*3. The first body portion 12*a*3 is provided between the first upper end portion 12*a*1 and the first lower end portion 12*a*2. While the first main pipe 12*a* illustrated in FIGS. 3 to 6 is a round-columnar refrigerant pipe, the first main pipe 12*a* is not limited thereto. The first main pipe 12*a* may alternatively be, for example, a polygonal-prism-shaped refrigerant pipe. If the first main pipe 12*a* has a round-columnar shape, the first upper end portion 12*a*1 and the first lower end portion 12*a*2 each have a round shape. The first upper end portion 12*a*1 and the first lower end portion 12*a*2 may each alternatively form a flat face, a curved face, or a conical body. The first upper end portion 12*a*1 and the first lower end portion 12*a*2 may be shaped differently from each other. The first body portion 12*a*3 of the first main pipe 12*a* receives the first feed pipe 33 of the refrigerant distributor pipe 30.

The first header pipe 12 further includes the plurality of first branch pipes 12*b* connected to the first main pipe 12*a* and to the heat exchanger tubes of the first heat-exchanger unit 7*a*. The plurality of first branch pipes 12*b* are arranged apart from one another. While the plurality of first branch pipes 12*b* illustrated in FIGS. 3 and 4 are connected to the first body portion 12*a*3 of the first main pipe 12*a*, some of the first branch pipes 12*b* may be connected to the first upper end portion 12*a*1 or the first lower end portion 12*a*2. The first branch pipes 12*b* are refrigerant pipes each having a smaller inside diameter than the first main pipe 12*a*. The first branch pipes 12*b* are, but are not limited to, straight refrigerant pipes. Some of the first branch pipes 12*b* may be refrigerant pipes including bent portions.

The second header pipe 13 includes the second main pipe 13*a* connected to the refrigerant distributor pipe 30. The second main pipe 13*a* includes a second upper end portion 13*a*1, a second lower end portion 13*a*2, and a second body portion 13*a*3. The second body portion 13*a*3 is provided between the second upper end portion 13*a*1 and the second lower end portion 13*a*2. While the second main pipe 13*a* illustrated in FIGS. 3 and 4 is a round-columnar refrigerant pipe, the second main pipe 13*a* is not limited thereto. The second main pipe 13*a* may alternatively be, for example, a polygonal-prism-shaped refrigerant pipe. If the second main pipe 13*a* has a round-columnar shape, the second upper end portion 13*a*1 and the second lower end portion 13*a*2 each have a round shape. The second upper end portion 13*a*1 and the second lower end portion 13*a*2 may each alternatively form a flat face, a curved face, or a conical body. The second upper end portion 13*a*1 and the second lower end portion 13*a*2 may be shaped differently from each other. The second body portion 13*a*3 of the second main pipe 13*a* receives the second feed pipe 35 of the refrigerant distributor pipe 30. As illustrated in FIG. 4, the second main pipe 13*a* may be at the same position as the first main pipe 12*a*. If the second main pipe 13*a* is at the same position as the first main pipe 12*a*, as illustrated in FIG. 6, the second main pipe 13*a* is hidden behind the first upper end portion 12*a*1 of the first main pipe 12*a*.

The second header pipe 13 further includes the plurality of second branch pipes 13*b* connected to the second main pipe 13*a* and to the heat exchanger tubes of the second heat-exchanger unit 7*b*. The plurality of second branch pipes 13*b* are arranged apart from one another. While FIGS. 3 and 4 illustrates an arrangement in which many of the second branch pipes 13*b* are connected to the second body portion 13*a*3 of the second main pipe 13*a* with the others being connected to the second lower end portion 13*a*2, the arrangement is not limited thereto. For example, some of the second branch pipes 13*b* may be connected to the second upper end portion 13*a*1. The second branch pipes 13*b* are refrigerant pipes each having a smaller inside diameter than the second main pipe 13*a*, While the second branch pipes 13*b* are straight refrigerant pipes in many cases, some of the second branch pipes 13*b* may be refrigerant pipes including bent portions, as illustrated in FIGS. 3 and 4.

Since the heat-source-side heat exchanger 7 includes two header pipes, which are the first header pipe 12 and the second header pipe 13, the first header pipe 12 and the second header pipe 13 are shorter in the longitudinal direction than in a configuration employing a single header pipe. Since the first header pipe 12 and the second header pipe 13 are short in the longitudinal direction, the thermal stress occurring when the first header pipe 12 and the second header pipe 13 undergo thermal expansion is reduced.

The refrigerant distributor pipe 30 includes the inflow pipe 31, the first feed pipe 33, the second feed pipe 35, and the splitter pipe 37. The refrigerant distributor pipe 30 is a refrigerant pipe that receives the high-temperature, high-pressure gas-phase refrigerant flowing thereinto through the inflow pipe 31 and splits the refrigerant at the splitter pipe 37 such that the high-temperature, high-pressure gas-phase refrigerant flows through both the first feed pipe 33 and the second feed pipe 35 into both the first main pipe 12*a* and the second main pipe 13*a*.

The inflow pipe 31 receives the high-temperature, high-pressure gas-phase refrigerant flowing thereinto from the compressor 11 through the first refrigerant pipe 50*a* illustrated in FIG. 1. The inflow pipe 31 extends along the first body portion 12*a*3 of the first main pipe 12*a* in a direction from the first lower end portion 12*a*2 toward the first upper end portion 12*a*1 The inflow pipe 31 extending along the first body portion 12*a*3 of the first main pipe 12*a* can be positioned in proximity to the first main pipe 12*a*. Therefore, the size of the space in the machine chamber 10*a* where the refrigerant pipes are arranged can be reduced. Consequently, the size of the outdoor unit 1 can be reduced.

The inflow pipe 31 receives at the upper end thereof the splitter pipe 37. The inflow pipe 31 further receives at the lower end thereof the first refrigerant pipe 50*a*, which is illustrated in FIG. 1 but is not illustrated in FIGS. 3 to 6. FIG. 4 illustrates by dotted lines a horizontal plane passing through a first center position O1, which is defined between the first upper end portion 12*a*1 and the first lower end portion 12*a*2 of the first main pipe 12*a*, and a horizontal plane passing through a second center position O2, which is defined between the second upper end portion 13*a*1 and the second lower end portion 13*a*2 of the second main pipe 13*a*.

As illustrated in FIG. 5, the splitter pipe 37 is, for example, a T-shaped three-way pipe or joint. The splitter pipe 37 is positioned above the first center position O1.

The splitter pipe 37 has three connection ports. With the refrigerant distributor pipe 30 being in the connected state, the three connection ports are positioned at the lower end, the upper end, and a lateral end, respectively, of the splitter pipe 37. The connection port at the lower end of the splitter pipe 37 receives the above-described inflow pipe 31. The splitter pipe 37 splits the high-temperature, high-pressure gas-phase refrigerant flowing thereinto from the inflow pipe 31 and discharges the refrigerant from the connection ports at the upper and lateral ends thereof. The splitter pipe 37 may have four or more connection ports. For example, the splitter pipe 37 may be a four-way splitter pipe including three connection ports and one port that is not connected to any pipe, with the one port being closed by any component such as a cap or a cap nut.

The first feed pipe 33 is connected to the connection port at the upper end of the splitter pipe 37 and to the first body portion 12*a*3 of the first main pipe 12*a*. The first feed pipe 33 is, for example, an L-shaped bent pipe as illustrated in FIG. 4.

The high-temperature, high-pressure gas-phase refrigerant discharged from the connection port at the upper end of the splitter pipe 37 flows through the first feed pipe 33 and flows into the first main pipe 12*a* from the first body portion 12*a*3 of the first main pipe 12*a*. In this process, the refrigerant flows in a direction substantially perpendicular to the first body portion 12*a*3. Therefore, the refrigerant collides with the inner wall of the first body portion 12*a*3 and is thus dispersed over the entirety of the first main pipe 12*a*. Inside the first main pipe 12*a*, since the refrigerant collides with the inner wall of the first body portion 12*a*3, the kinetic energy of the refrigerant that is caused in correspondence with the flow velocity at the time of inflow is reduced and the refrigerant is dispersed in dependence on gravity and pressure. Hence, the evenness in the dispersion is increased. Thus, the unevenness in the dispersion of the refrigerant inside the first main pipe 12*a* is reduced. Accordingly, the temperature variation inside the first main pipe 12*a* is reduced. Therefore, the occurrence of a thermal stress on the first main pipe 12*a* is suppressed. Consequently, the occurrence of deformation of the first branch pipes 12*b* due to a thermal stress that may be applied thereto is suppressed. Thus, the reliability of the outdoor unit 1 of the refrigeration cycle apparatus 100 is increased.

As illustrated in FIG. 4, the first feed pipe 33 is connected to the first body portion 12*a*3 at a position closer to the first upper end portion 12*a*1 than the first center position O1. That is, a first connection position 33*a*, where the first feed pipe 33 and the first body portion 12*a*3 are connected to each other, is closer to the first upper end portion 12*a*1 of the first main pipe 12*a* than to the first lower end portion 12*a*2 of the first main pipe 12*a*. In general, refrigerants other than those such as ammonium are heavier than air and are therefore more likely to be dispersed toward the first lower end portion 12*a*2 than toward the first upper end portion 12*a*1 in the first main pipe 12*a* under gravity. If the pressure inside the first main pipe 12*a* is not constant, the amount of dispersion toward the first upper end portion 12*a*1 may be reduced. However, if the first feed pipe 33 is connected to the first body portion 12*a*3 at a position closer to the first upper end portion 12*a*1 than the first center position O1, the closeness between the first connection position 33*a* and the first upper end portion 12*a*1 increases the amount of dispersion toward the first upper end portion 12*a*1 . Thus, connecting the first feed pipe 33 to the first body portion 12*a*3 at a position above the first center position O1 further increases the evenness in the dispersion of the refrigerant.

In FIGS. 4 to 6, the center axis, C1, of the first feed pipe 33 at the first connection position 33*a* and the center axis, C2, of the first branch pipes 12*b* are represented by dotted lines. The center axis C1 of the first feed pipe 33 at the first connection position 33*a* is a straight line extending in a direction coinciding with the direction of a line normal to a plane defining the first connection position 33*a*.

As illustrated in FIGS. 4 to 6, the center axis C1 is in a skewed position with respect to the center axis O2. Hereinafter, the term "skewed position" refers to a positional relationship in which two straight lines cannot coexist in a single plane: that is, the two straight lines neither extend parallel to each other nor intersect each other. In the arrangement illustrated in FIGS. 5 and 6, the skewed position refers to a positional relationship in which the center axis C1 and the center axis C2 cannot coexist in a single plane: that is, the center axis C1 neither extends parallel to the center axis C2 nor intersects the center axis C2.

Since the center axis C1 of the first feed pipe 33 at the first connection position 33*a* is in a skewed position with respect to the center axis C2 of the first branch pipes 12*b*, the high-temperature, high-pressure gas-phase refrigerant flowing from the first connection position 33*a* is prevented from directly flowing into the first branch pipes 12*b*. Specifically, the high-temperature, high-pressure gas-phase refrigerant flowing from the first connection position 33*a* collides with the inner wall of the first main pipe 12*a* and does not directly flow into the first branch pipes 12*b*. Instead, the refrigerant is dispersed toward the first upper end portion 12*a*1 and toward the first lower end portion 12*a*2. Thus, the evenness in the dispersion of the refrigerant is further increased.

Furthermore, the center axis C1 of the first feed pipe 33 at the first connection position 33*a* is in a skewed position with respect to the center axis C2 of the first branch pipes 12*b*, and therefore the first feed pipe 33 is not positioned across the first main pipe 12*a* from any of the first branch pipes 12*b*. Therefore, the space where the refrigerant pipes connected to the heat-source-side heat exchanger 7 are arranged does not spread radially from the first main pipe 12*a* in top view. Consequently, the size of the outdoor unit 1 can be reduced.

The second feed pipe 35 is connected to the connection port at the lateral end of the splitter pipe 37 and to the second body portion 13*a*3 of the second main pipe 13*a*. The second feed pipe 35 includes an inflow portion 35*a*, a feed portion 35*b*, and a coupling portion 35*c*. The inflow portion 35*a* is connected to the connection port at the lateral end of the splitter pipe 37. The feed portion 35*b* is connected to the second body portion 13*a*3 of the second main pipe 13*a*. The coupling portion 35*c* is connected to the inflow portion 35*a* and to the feed portion 35*b*. The high-temperature, high-pressure gas-phase refrigerant discharged from the connection port at the lateral end of the splitter pipe 37 flows through the inflow portion 35*a*, the coupling portion 35*c*, and the feed portion 35*b* and flows into the second main pipe 13*a* from the second body portion 13*a*3 of the second main pipe 13*a*.

As illustrated in FIGS. 4 and 5, the inflow portion 35*a* of the second feed pipe 35 is an L-shaped bent pipe. As illustrated in FIG. 4, the inflow portion 35*a* of the second feed pipe 35 is connected to the connection port at the lateral end of the splitter pipe 37 at a position above the second center position O2.

Herein, a straight line extending in a direction coinciding with the axial direction of the connection port at the lateral end of the splitter pipe 37 is defined as the center axis, C3, of the inflow portion 35*a* of the second feed pipe 35. As illustrated in FIGS. 4 to 6, the center axis C3 of the inflow portion 35*a* of the second feed pipe 35 is in a skewed position with respect to both the center axis C1 of the first feed pipe 33 at the first connection position 33*a* and the center axis C2 of the first branch pipes 12*b*. In such a positional relationship, the space where the refrigerant pipes connected to the heat-source-side heat exchanger 7 are arranged does not spread radially from the first main pipe 12*a* in top view. Consequently, the size of the outdoor unit 1 can be reduced.

As illustrated in FIGS. 3 and 4, the feed portion 35*b* of the second feed pipe 35 is an L-shaped bent pipe and is connected to the second body portion 13*a*3. As illustrated in FIG. 4, the feed portion 35*b* of the second feed pipe 35 is connected to the second body portion 13*a*3 at a position above the second center position O2. The feed portion 35*b* of the second feed pipe 35 that is connected to the second body portion 13*a*3 corresponds to the first feed pipe 33 connected to the first body portion 12*a*3. The functions and advantageous effects exerted by the feed portion 35*b* of the second feed pipe 35 are the same as those exerted by the first feed pipe 33.

As illustrated in FIGS. 4 and 6, the center axis, C4 of the feed portion 35*b* of the second feed pipe 35 at a second connection position 35*b*1, where the feed portion 35*b* of the second feed pipe 35 and the second body portion 13*a*3 are connected to each other, can also be set in a skewed position with respect to the center axis, C5, of the second branch pipes 13*b*. The center axis C4 of the feed portion 35*b* of the second feed pipe 35 at the second connection position 35*b*1 is a straight line extending in a direction coinciding with the direction of a line normal to a plane defining the second connection position 35*b*1. The functions and advantageous effects exerted by the feed portion 35*b* of the second feed pipe 35 are the same as those exerted by the first feed pipe 33.

In the second feed pipe 35, the coupling portion 35*c* connected to the inflow portion 35*a* and to the feed portion 35*b* extends along the first body portion 12*a*3 of the first main pipe 12*a* and the second body portion 13*a*3 of the second main pipe 13*a*. The coupling portion 35*c* of the second feed pipe 35 extends in a direction from the first upper end portion 12*a*1 toward the first lower end portion 12*a*2 of the first main pipe 12*a* and in a direction from the second upper end portion 13*a*1 toward the second lower end portion 13*a*2 of the second main pipe 13*a*. The coupling portion 35*c* of the second feed pipe 35 that extends along the first body portion 12*a*3 of the first main pipe 12*a* and the second body portion 13*a*3 of the second main pipe 13*a* can be positioned in proximity to the first main pipe 12*a* and the second main pipe 13*a*, Therefore, the size of the space in the machine chamber 10*a* where the refrigerant pipes are arranged can be reduced. Consequently, the size of the outdoor unit 1 can be reduced.

Embodiment 2

Figure 7:
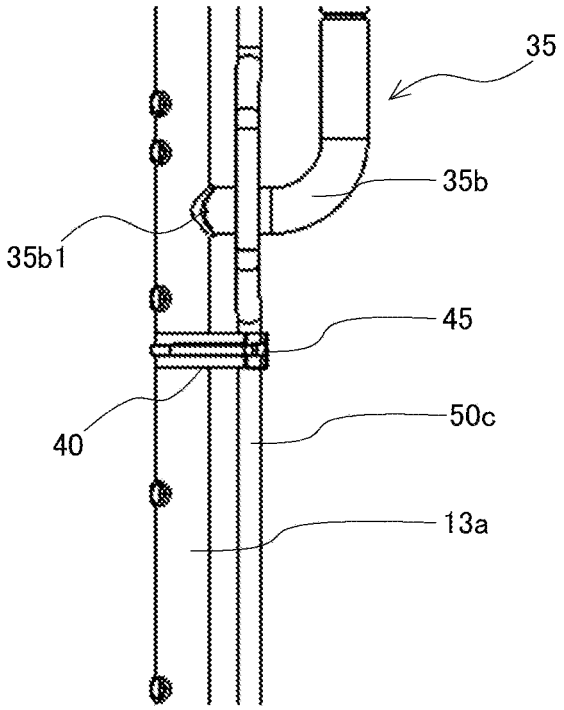
FIG. 7 is an enlargement of a part of refrigerant pipes connected to a heat-source-side heat exchanger according to Embodiment 2, schematically illustrating an exemplary arrangement thereof.

An outdoor unit 1 of a refrigeration cycle apparatus 100 according to Embodiment 2 will now be described with reference to FIG. 7. FIG. 7 is an enlargement of a part of refrigerant pipes connected to a heat-source-side heat exchanger 7 according to Embodiment 2, schematically illustrating an exemplary arrangement thereof.

The refrigerant pipes connected to the heat-source-side heat exchanger 7 that are illustrated in FIG. 7 include the second main pipe 13*a* and the third refrigerant pipe 50*c*. The second main pipe 13*a* and the third refrigerant pipe 50*c* are provided therearound with a vibration isolator 40. Furthermore, the second main pipe 13*a* and the third refrigerant pipe 50*c* are bound together by a tie 45 with the vibration isolator 40 interposed in between. The vibration isolator 40 is made of, for example, a butadiene rubber sheet. The tie 45 is a band such as a metal band or a plastic binding band. Binding the second main pipe 13*a* and the third refrigerant pipe 50*c* by using the vibration isolator 40 and the tie 45 suppresses the vibration of the third refrigerant pipe 50*c*. Instead of the second main pipe 13*a*, the first main pipe 12*a* may be bound. Instead of the third refrigerant pipe 50*c*, the second refrigerant pipe 50*b*, which is another low-temperature-side refrigerant pipe, may be bound.

When the outdoor unit 1 is activated, the compressor 11 tends to vibrate. Such vibration may be transmitted to relevant elements through the refrigerant pipes. If the frequency of vibration occurring in the compressor 11 is the same as the natural frequency of any of the refrigerant pipes, that refrigerant pipe resonates, which may deform the refrigerant pipe. Among the refrigerant pipes connected to the heat-source-side heat exchanger 7, any lengthy refrigerant pipe that is straight in large part particularly tends to vibrate significantly. Therefore, it is effective to wind the vibration isolator 40 around the second refrigerant pipe 50*b* and the third refrigerant pipe, which are low-temperature-side refrigerant pipes. Among the refrigerant pipes connected to the heat-source-side heat exchanger 7, the refrigerant pipes provided between the compressor 11 and the heat-source-side heat exchanger 7 tend to receive the vibration transmitted from the compressor 11. Therefore, it is also effective to wind the vibration isolator 40 around the coupling portion 35*c* of the second feed pipe 35, the inflow pipe 31 of the refrigerant distributor pipe 30, and the first refrigerant pipe 50*a*. If the vibration isolator 40 is employed as a vibration-isolation measure for the second refrigerant pipe 50*b* and the third refrigerant pipe 50*c*, which are low-temperature-side refrigerant pipes, and for the coupling portion 35*c* of the second feed pipe 35, the inflow pipe 31 of the refrigerant distributor pipe 30, and the first refrigerant pipe 50*a*, the reliability of the outdoor unit 1 is increased.

REFERENCE SIGNS LIST

1: outdoor unit, 2*a*: first side panel, 2*b*: second side panel, 2*c*: third side panel, 2*c*1: opening, 2*d*: fourth side panel, 3: top panel, 4: bottom panel, 5: exhaust grille, 6: leg, 7: heat-source-side heat exchanger, 7*a*: first heat-exchanger unit, 7*b*: second heat-exchanger unit, 8: fan, 10: separator, 10*a*: machine chamber, 10*b*: fan chamber, 11: compressor, 12: first header pipe, 12*a*: first main pipe, 12*a*1 : first upper end portion, 12*a*2: first lower end portion, 12*a*3: first body portion, 12*b*: first branch pipe, 13: second header pipe, 13*a*: second main pipe, 13*a*1: second upper end portion, 13*a*2: second lower end portion, 13*a*3: second body portion, 13*b*: second branch pipe, 14: first distributor, 14*a*: third main pipe, 14*b*: third branch pipe, 15: second distributor, 15*a*: fourth main pipe, 15*b*: fourth branch pipe, 16: refrigerant passage switcher, 18: accumulator, 20: indoor unit, 21: load-side heat exchanger, 23: decompressor, 30: refrigerant distributor pipe, 31: inflow pipe, 33: first feed pipe, 33*a*: first connection position, 35: second feed pipe, 35*a*: inflow portion, 35*b*: feed portion, 35*b*1: second connection position, 35*c*: coupling portion, 37: splitter pipe, 40: vibration isolator, 45: tie, 50*a*: first refrigerant pipe, 50*b*: second refrigerant pipe, 50*c*: third refrigerant pipe, 50*d*: fourth refrigerant pipe, 52: combining unit, 100: refrigeration cycle apparatus

The invention claimed is:

1. An outdoor unit of a refrigeration cycle apparatus, the outdoor unit comprising:

a compressor configured to compress and discharge refrigerant;

a heat-source-side heat exchanger including a first heat-exchanger unit and a second heat-exchanger unit, the second heat-exchanger unit being provided below the first heat-exchanger unit;

a first header pipe including a first main pipe and a plurality of first branch pipes, the first main pipe including a first upper end portion, a first lower end portion, and a first body portion provided between the first upper end portion and the first lower end portion, the plurality of first branch pipes being connected to the first main pipe and to the first heat-exchanger unit and being arranged apart from one another;

a second header pipe including a second main pipe and a plurality of second branch pipes, the second main pipe including a second upper end portion, a second lower end portion, and a second body portion provided between the second upper end portion and the second lower end portion, the plurality of second branch pipes being connected to the second main pipe and to the second heat-exchanger unit and being arranged apart from one another; and a refrigerant distributor pipe including an inflow pipe into which the refrigerant discharged from the compressor flows, a splitter pipe connected to the inflow pipe, a first feed pipe connected to the splitter pipe and to the first body portion, and a second feed pipe connected to the splitter pipe and to the second body portion, wherein the first feed pipe is connected in a direction perpendicular to the first body portion at a position closer to the first upper end portion than a first center position defined between the first upper end portion and the first lower end portion, and the second feed pipe is connected in a direction perpendicular to the second body portion at a position closer to the second upper end portion than a second center position defined between the second upper end portion and the second lower end portion.

2. The outdoor unit of the refrigeration cycle apparatus of claim 1, wherein a center axis of the first feed pipe in a first connection position at which the first feed pipe and the first body portion are connected to each other is in a skewed position with respect to a center axis of each of the plurality of first branch pipes.

3. The outdoor unit of the refrigeration cycle apparatus of claim 1, wherein a center axis of the second feed pipe in a second connection position at which the second feed pipe and the second body portion are connected to each other is in a skewed position with respect to a center axis of each of the plurality of second branch pipes.

4. The outdoor unit of the refrigeration cycle apparatus of claim 1, further comprising:

a housing that houses the compressor and the heat-source-side heat exchanger;

a vibration isolator wound around a refrigerant pipe and one of the first main pipe and the second main pipe, the refrigerant pipe being connected to the heat-source-side heat exchanger and being housed in the housing, the refrigerant pipe being other than the first header pipe and the second header pipe; and a tie that binds the first main pipe or the second main pipe and the refrigerant pipe together, with the vibration isolator interposed in between.

5. The outdoor unit of the refrigeration cycle apparatus of claim 4, wherein the refrigerant pipe is a low-temperature-side refrigerant pipe connected to the heat-source-side heat exchanger.

* * * * *